US010492548B2

(12) United States Patent
Marriott et al.

(10) Patent No.: US 10,492,548 B2
(45) Date of Patent: Dec. 3, 2019

(54) GLOVES FOR ADJUSTING AND CONTROLLING RESISTANCE TO HAND MOVEMENT, AND RELATED METHODS THEREOF

(71) Applicants: Dean R. Marriott, Edmonton (CA); Daniel A. Sawchuk, Calgary (CA); Jonathan A. Cheung, Edmonton (CA)

(72) Inventors: Dean R. Marriott, Edmonton (CA); Daniel A. Sawchuk, Calgary (CA); Jonathan A. Cheung, Edmonton (CA)

( * ) Notice: Subject to any disclaimer, the term of this patent is extended or adjusted under 35 U.S.C. 154(b) by 0 days.

(21) Appl. No.: 16/053,901

(22) Filed: Aug. 3, 2018

(65) Prior Publication Data

US 2018/0338553 A1 Nov. 29, 2018

Related U.S. Application Data

(63) Continuation of application No. 14/277,305, filed on May 14, 2014, now Pat. No. 10,076,143.

(51) Int. Cl.
*A41D 19/00* (2006.01)
*A63B 21/04* (2006.01)
(Continued)

(52) U.S. Cl.
CPC ..... *A41D 19/0024* (2013.01); *A63B 21/0407* (2013.01); *A63B 21/0421* (2013.01); *A63B 21/0552* (2013.01); *A63B 21/4019* (2015.10); *A63B 21/4025* (2015.10); *A63B 23/14* (2013.01); *A63B 23/16* (2013.01); *A41D 2400/32* (2013.01); *A63B 21/00069* (2013.01)

(58) Field of Classification Search
CPC ..... A63B 21/1438; A63B 21/1449; A63B 21/0552; A63B 21/4019–4021; A63B 23/14–16; A63B 21/02–0557
See application file for complete search history.

(56) References Cited

U.S. PATENT DOCUMENTS 3,944,220 A * 3/1976 Fasano ..... A63B 21/0552 482/47
5,308,305 A * 5/1994 Romney ..... A63B 21/00069 2/69

(Continued)

OTHER PUBLICATIONS

Vasisilis Gerodimos et al., Age Related Differences in Peak Handgrip Strength Between Wrestlers and Nonathletes During the Developmental Years, Journal of Strength and Conditioning Research, 2013, pp. 616-623, 27(3), National Strength and Conditioning Association, Greece.

(Continued)

*Primary Examiner* — Jennifer M Deichl
(74) *Attorney, Agent, or Firm* — Cahn & Samuels, LLP

(57) ABSTRACT

A glove having a top surface and a bottom surface is described herein. The top surface and the bottom surface each have an inner surface and an outer surface. The glove includes a plurality of resistance bands, which can be configured to be removably attached to the glove. The resistance bands can be removably attached at connection points on the outer surface of the glove. The glove can also include at least one adjustable resistance mechanism connected to the glove. The adjustable resistance mechanism is configured to adjust degrees of resistance to motion via the resistance bands.

15 Claims, 2 Drawing Sheets

(51) Int. Cl.

| | |
|---|---|
| ***A63B 21/055*** | (2006.01) |
| ***A63B 23/14*** | (2006.01) |
| ***A63B 23/16*** | (2006.01) |
| ***A63B 21/00*** | (2006.01) |

(56) References Cited

U.S. PATENT DOCUMENTS

| | | | | |
|---|---|---|---|---|
| 5,538,488 | A * | 7/1996 | Villepigue | A63B 21/0004 482/44 |
| 7,415,735 | B2 * | 8/2008 | Erickson | A41D 19/01547 2/163 |
| 8,790,224 | B1 * | 7/2014 | Davis | A63B 21/0084 441/50 |
| 8,944,942 | B2 * | 2/2015 | Oravecz | A63B 21/00185 473/518 |
| 2003/0195093 | A1 * | 10/2003 | White | A63B 21/0552 482/124 |
| 2010/0311546 | A1 * | 12/2010 | Kupferman | A63B 21/0004 482/47 |

OTHER PUBLICATIONS

Maurizio Fanchini et al., Differences in Climbing-Specific Strength Between Boulder and Lead Rock Climbers, Journal of Strength and Conditioning Research, 2013, pp. 310-314, 27(2), National Strength and Conditioning Association.

David J. Szymanski et al., Effect of 21 Weeks of Wrist and Forearm Training on High School Baseball Players, Journal of Strength and Conditioning Research, 2004, pp. 432-440, 18(3), National Strength & Conditioning Association, United States.

Troy B. Adams et al., Effect of Toe and Wrist/ Finger Flexor Strength Training on Athletic Performance, Journal of Applied Sport Science Research, 1988, pp. 31-34, 2(2), Human Performance Laboratory and Physical Education Sports Department, United States.

Angel Borelli, Engineering a Strong Pitching Elbow: An Off-Season Training Plan, Gym Science Sport Performance, 2009, pp. 64-73, 31(2), National Strength and Conditioning Association, United States.

Trosclair et al., Hand-Grip Strength as a Predictor of Muscular Strength and Endurance, Journal of Strength and Conditioning Research, 2011, p. S99, 25(1), National Strength and Conditioning Association, United States.

Milvi Visnaptu and Toivo Jurimae, Handgrip Strength and Hand Dimensions in Young Handball and Basketball Players, Journal of Strength and Conditioning Research, 2007, pp. 923-929, 21(3), National Strength and Conditioning Association, Estonia.

Taina Rantanen et al., Midlife Hand Grip Strength as a Predictor of Old Age Disability, Jama, 1999, pp. 558-560, 281(6), American Medical Association, United States.

Kevin C. Phillips et al., Optimizing Rock Climbing Performance Through Sport-Specific Strength and Conditioning, Strength and Conditioning Journal, 2012, pp. 1-18, 34(3), Lippincott Williams & Wilkins, United States.

Helen Binkley, David Smith and Stephanie Wise, Rehabilitation and Return to Sport After Scaphoid Fractures, Strength and Conditioning Journal, 2012, pp. 24-33, 34(5), Lippincott Williams & Wilkins, United States.

Fry et al., Relationships Between Muscular Strength and Batting Performances in Collegiate Baseball Athletes, Journal of Strength and Conditioning Research, 2011, pp. S19-S20, 25(1), National Strength and Conditioning Association, United States.

Constance B. Christ et al., Reliability of Select Parameters of Isometric Muscle Function Associated with Testing 3 Days X 3 Trials in Women, Journal of Strength and Conditioning Research, 1994, pp. 65-71, 8(2), National Strength and Conditioning Association, United States.

Staci Stevens, Forearm and Hand Strength for Volleyball, National Strength and Conditioning Association Journal, 1993, pp. 63-66, 15(5), United States.

William E. Moore et al. Strength and Revolver Marksmanship, Journal of Applied Sport Science Research, 1992, pp. 239-248, 6(4), United States.

Juan G. Bonitch-Gongora et al., The Effect of Lactate Concentration on the Handgrip Strength During Judo Bouts, Journal of Strength and Conditioning Research, 2012, pp. 1863-1871, 26(7), National Strength and Conditioning Association, Spain.

David Szymanski and Coop Derenne, The Effects of Small Muscle Training on Baseball Hitting Performance: A Brief Review, Strength and Conditioning Journal, 2010, pp. 99-108, 32(6), Lippincott Williams & Wilkins, United States.

* cited by examiner

GLOVES FOR ADJUSTING AND CONTROLLING RESISTANCE TO HAND MOVEMENT, AND RELATED METHODS THEREOF

CROSS-REFERENCES TO RELATED APPLICATIONS

This application is a continuation of U.S. application Ser. No. 14/277,305 filed on May 14, 2014, the entirety of which is herein incorporated by reference.

BACKGROUND

The present disclosure generally relates to gloves and methods for use thereof. More specifically, the present disclosure is related to gloves having variable resistance, which are beneficial for enhancing athletic performance, muscle strength, development, flexibility, and rehabilitation, etc. of hands, including digits and related body parts (e.g., wrist, forearm).

Many activities require the exercise, use, conditioning, training, strengthening, improvement, and/or otherwise development of various muscles in the hand(s), including fingers and related body parts (e.g., wrist, forearm). A subject's hand(s) might also become injured, at which point various rehabilitative treatment methods and/or physical therapy would be warranted.

Examples of devices available for the conditioning, development and/or strength training of hand muscles and related body parts include hand exercise grippers, hand exercise squeeze balls, hand dynamometers, hand exercise webs with several holes to place fingers in, and hand exercise elastic bands.

Examples of rehabilitative treatment methods for hand and related injuries include placing an individual's hand in containers of sand or rice to gradually practice grabbing and twisting handfuls of the rice or sand. Moreover, methods available for conditioning, development and/or strength training are generally interchangeable with related methods for rehabilitative treatment.

The above-described devices and methods are limited in typically allowing for movement of one or a limited number of sections of the hand, and in only one or a limited number of directions and/or ranges of motion. For instance, squeeze balls limit a user's movement to incorporating most or all of the fingers of the hand to grip the squeeze ball, and in some instances roll the squeeze ball on a flat surface. As a result, squeeze balls do not engage a user in a number of finger articulations, such as adduction and abduction, as well as allow for movement of individual fingers at varying levels of resistance in any one of three general directions (−x, −y, and −z). Similar limitations and drawbacks exist for rubber bands, hand exercise grippers, and even for containers of rice or sand. Namely, containers of rice or sand do not provide for a controlled, variable resistance mechanism for movement of the hand in various directions, and further limit the user to remaining in a stationary position while using the container device.

Accordingly, there exists a need for devices and methods thereof for enhancing athletic performance, muscle strength, development, flexibility, and rehabilitation, etc. of hands, including fingers and related body parts, said devices having variable resistance in all available directions of motion, and said devices not limited to stationary use by the user.

SUMMARY

According to embodiments of the present invention, a glove is provided. The glove has a top surface and a bottom surface, where each of the top surface and the bottom surface has an inner and an outer surface. The glove includes a plurality of connection points positioned across an outer surface area of the glove. A plurality of resistance bands is also included, and configured to be removable attached to the plurality of connection points. At least one adjustable resistance mechanism is connected to the glove. The at least one adjustable resistance mechanism is configured to adjust degrees of resistance to motion via the plurality of resistance bands. The glove is also configured to allow for movement of the hand and digits of the hand in all available directions.

According to alternate embodiments of the present invention, a glove is provided having a top surface and a bottom surface. Each of the top surface and the bottom surface has an inner and an outer surface. The glove includes a plurality of resistance bands fixably attached throughout an outer surface area of the glove. The glove is configured to allow for movement of the hand and digits in all available directions.

Optionally, the at least one adjustable resistance mechanism can be configured to individually control and/or adjust resistance for at least one and up to all of metacarpophalangeal flexion movement, metacarpophalangeal extension movement, metacarpophalangeal abduction movement, metacarpophalangeal adduction movement, and metacarpophalangeal circumduction movement.

Optionally, the at least one adjustable resistance mechanism can also be configured to individually control and/or adjust resistance for at least one and up to all of interphalangeal flexion movement and interphalangeal extension movement.

Optionally, the at least one adjustable resistance mechanism can also be configured to individually control and/or adjust resistance for digit flexion movement and digit extension movement.

Optionally, the at least one adjustable resistance mechanism can also be configured to individually control and/or adjust resistance for digit adduction movement and digit abduction movement.

Optionally, the at least one adjustable resistance mechanism can also be configured to individually control and/or adjust resistance for digit circumduction movement.

Optionally, the at least one adjustable resistance mechanism can also be configured to individually control and/or adjust resistance for thumb movement.

A method for adjusting and controlling resistance to hand movement is also provided herein. The method includes applying a glove to cover the hand, the glove having a plurality of resistance bands. Degrees of resistance to motion are adjusted via the resistance bands on the glove.

BRIEF DESCRIPTION OF THE SEVERAL VIEWS OF THE DRAWINGS

The present disclosure may be better understood, and its numerous features and advantages made apparent to those skilled in the art by referencing the accompanying drawings.

DETAILED DESCRIPTION

As used herein "substantially", "relatively", "generally", "about", and "approximately" are relative modifiers intended to indicate permissible variation from the characteristic so modified. They are not intended to be limited to the absolute value or characteristic which it modifies but rather approaching or approximating such a physical or functional characteristic.

In this detailed description, references to "one embodiment", "an embodiment", or "in embodiments" mean that the feature being referred to is included in at least one embodiment of the invention. Moreover, separate references to "one embodiment", "an embodiment", or "embodiments" do not necessarily refer to the same embodiment; however, neither are such embodiments mutually exclusive, unless so stated, and except as will be readily apparent to those skilled in the art. Thus, the invention can include any variety of combinations and/or integrations of the embodiments described herein.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the root terms "include" and/or "have", when used in this specification, specify the presence of stated features, integers, steps, operations, elements, and/or components, but do not preclude the presence or addition of at least one other feature, integer, step, operation, element, component, and/or groups thereof.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

As used herein, and unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Various embodiments of the present disclosure will now be described, by way of example only, with reference to the accompanying drawings.

Figure 1:
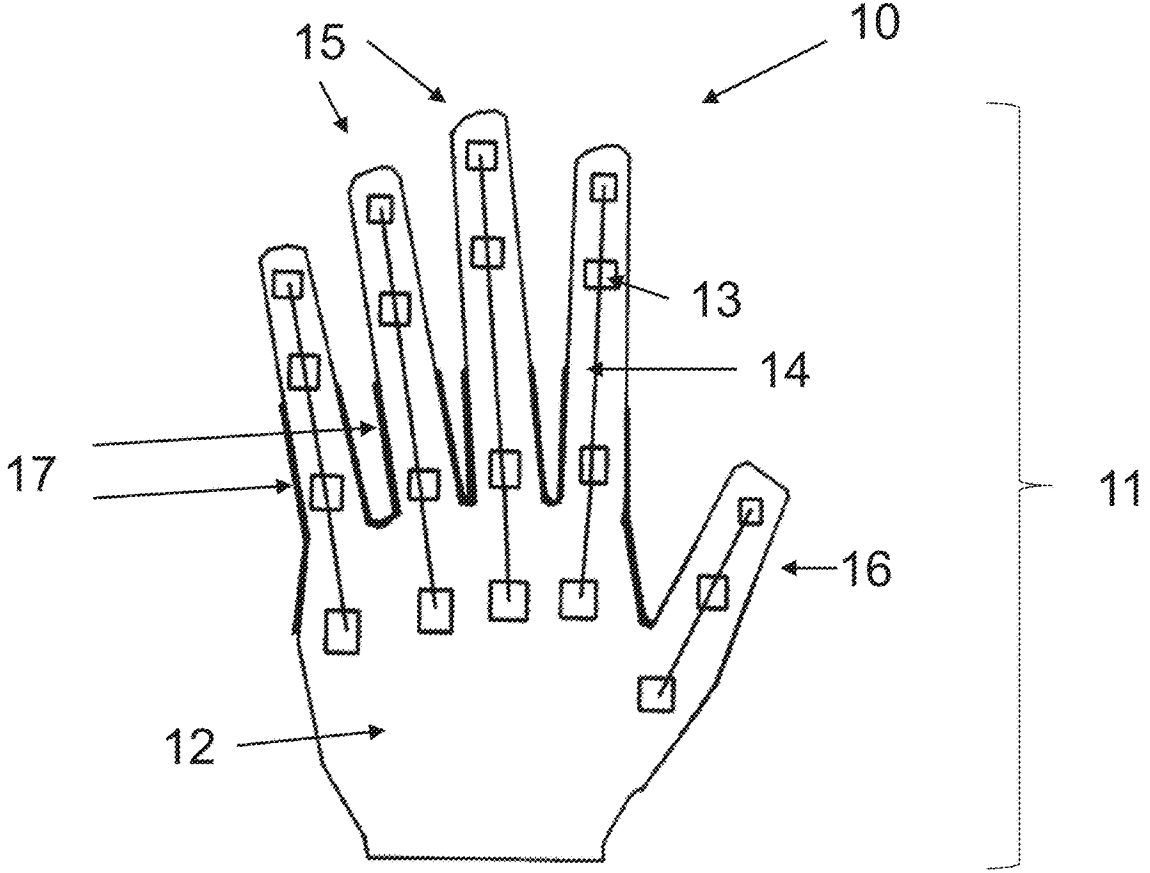
FIG. 1 is an illustration of a glove according to one embodiment of the present invention.

With reference to FIG. 1, a glove 10 according to embodiments of the present invention is provided. The glove 10 can cover the entirety of a human hand 11, including each of a plurality of digits 15, or fingers, in reference to the digits 15 of the human hand 11. The digits 15 of the human hand 11 include a thumb 16.

As shown in FIG. 1, the glove 10 can be configured to individually and/or completely cover each of the digits 15 of the human hand 11.

Alternatively, although not illustrated in FIG. 1, the glove 10 can be configured to cover less than all of the digits 15 of the human hand 11; or the glove 10 can be configured to partially cover one and up to all of the digits 15 of the human hand 11 (e.g., the glove 10 can have openings at one and up to all of the tips of said digits 15). It is also envisioned that the glove 10 can also be configured to partially cover one and up to all of the digits 15 of the human hand 11, said covering available in varying levels of coverage (e.g., partial coverage, covering any one and up to all of the digit(s) of the hand but only covering up to the first joint of said digit(s), completely covering only two of the digits of the human hand, and partially covering the rest, etc.).

In embodiments, the glove 10 can be configured to allow for movement of the hand 11 and the digits 15 in all anatomically available and/or allowable directions. The glove 10 can also be configured to allow for adjustable tension and/or restricted movement in any one and up to all of the anatomically available and/or allowable directions, hand and finger articulations, and movements.

In certain embodiments, the glove 10 can be configured to allow for movement in limited directions. As an example, in cases where the user is injured and cannot move his/her index finger, the glove 10 be configured to allow for movement of digits 15 with the exception of the index finger. As another example, in cases where the user desires to train only a select number of digits 15, a glove 10 can be configured to allow for only certain degrees of movement for said select number of digits 15.

The glove 10 can include a top surface 12 and a bottom surface (not illustrated). The top surface 12 of the glove 10 is the surface that is closest in contact with a top surface of the hand 11; and the bottom surface of the glove 10 is the surface that is in closest in contact with a bottom surface (such as a palm) of the hand 11. It will be appreciated that the top surface 12 and bottom surface of the glove 10, respectively, also includes those surfaces which extend over and one and up to all of the digits 15 of the human hand 11, whether partially or completely, or any variance in degree of coverage.

The top surface 12 and bottom surface of the glove 10 can each include an inner and an outer surface (not illustrated). The inner surface of the top surface 12 of the glove 10 can generally be in direct contact with the top surface of the hand 11. Likewise, the outer surface of the top surface 12 of the glove 10 can correspond a portion of the total outer surface area of the glove 10. The inner surface of the bottom surface of the glove 10 can generally be in direct contact with the palm of the hand 11. The outer surface of the bottom surface of the glove 10 can correspond to a portion of the total outer surface area of the glove 10.

The glove 10 can also include a plurality of connection points 13 positioned across an outer surface area of the glove 10. In embodiments, the connection points 13 can be present on a portion and up to substantially all of the top surface 12 of the glove 10, with no resistance bands present on or connected to parts located across the bottom surface of the glove 10. In particular, the connection points 13 can be present on a portion and up to substantially all of the outer surface of the top surface 12 of the glove 10.

Alternatively, the connection points 13 can be present on a portion including up to substantially all of only the bottom surface of the glove 10, with no connection points 13 present on the top surface 12 of the glove 10. In particular, the connection points 13 can be present on a portion and up to substantially all of the outer surface of the bottom surface of the glove 10.

The connection points 13 can also be present on portion(s) and/or regions across the entire outer surface area of the glove 10, meaning at least portions and/or regions located on both the outer surfaces of the top surface 12 and bottom surface of the glove 10. In particular, the connection points 13 can be present on a portion and up to substantially all of the outer surfaces of both the top surface 12 and the bottom surface of the glove 10.

In embodiments, the connection points 13 can be located at positions corresponding to digit 15 joint locations, in accordance with the anatomy of the hand 11. As shown in FIG. 1, the connection points 13 are generally positioned at joint locations, knuckle locations, locations close to the tips of the digits 15, and locations corresponding to the locations on the top surface area of the hand 11.

In certain embodiments, the connection points 13 can be evenly or uniformly distributed throughout all or a portion of the outer surface area of the glove 10. In alternate embodiments, the connection points 13 can be non-uniformly distributed throughout all or a select portion(s) of the outer surface area of the glove 10.

The glove 10 also includes a plurality of resistance bands 14 spread across the outer surface area of the glove 10. As such, suitable connection points 13 include, but are not limited to, connection points 13 that are configured to anchor the plurality of resistance bands 14 to the glove 10.

Similar to the connection points 13, the resistance bands 14 can be present on a portion and up to substantially all of only the top surface 12 of the glove 10, on a portion and up to substantially all of only the bottom surface of the glove 10, or the resistance bands 14 can be present on a portion and up to substantially all of the surface area across the entire outer surface area of the glove 10, meaning at least portions of both the top 12 and bottom surfaces of the glove 10.

In particular, with regard to the above-described configured, the resistance bands 14 can be present on a portion and up to substantially all of only the outer surface of the top surface 12 of the glove 10, on a portion and up to substantially all of only the outer surface of the bottom surface of the glove 10, or the resistance bands 14 can be present on a portion and up to substantially all of the surface area across the entire outer surface area of the glove 10, meaning at least portions of both outer surfaces of the top 12 and bottom surface of the glove 10.

In certain embodiments, the resistance bands 14 can be uniformly or evenly distributed throughout all or a portion of the outer surface area of the glove 10, regardless of whether the resistance bands 14 are present on all or a part of the top surface 12, all or a part of the bottom surface of the glove 10, or on all or a part of both top 12 and bottom surfaces of the glove 10.

In alternate embodiments, the resistance bands 14 can be non-uniformly distributed throughout all or a select portion(s) of the outer surface area of the glove 10.

FIG. 1 illustrates a glove 10 embodiment where the resistance bands 14 substantially exist within the planar surface or planar surface area of the hand 11 and/or the glove 10, the planar surface being substantially parallel to the surface of the hand 11 and/or the glove 10. That is to say, substantially no portion of the resistance bands 14 extend to an area that is outside of the planar surface or planar surface area of the hand 11 and/or glove 10.

Figure 2:
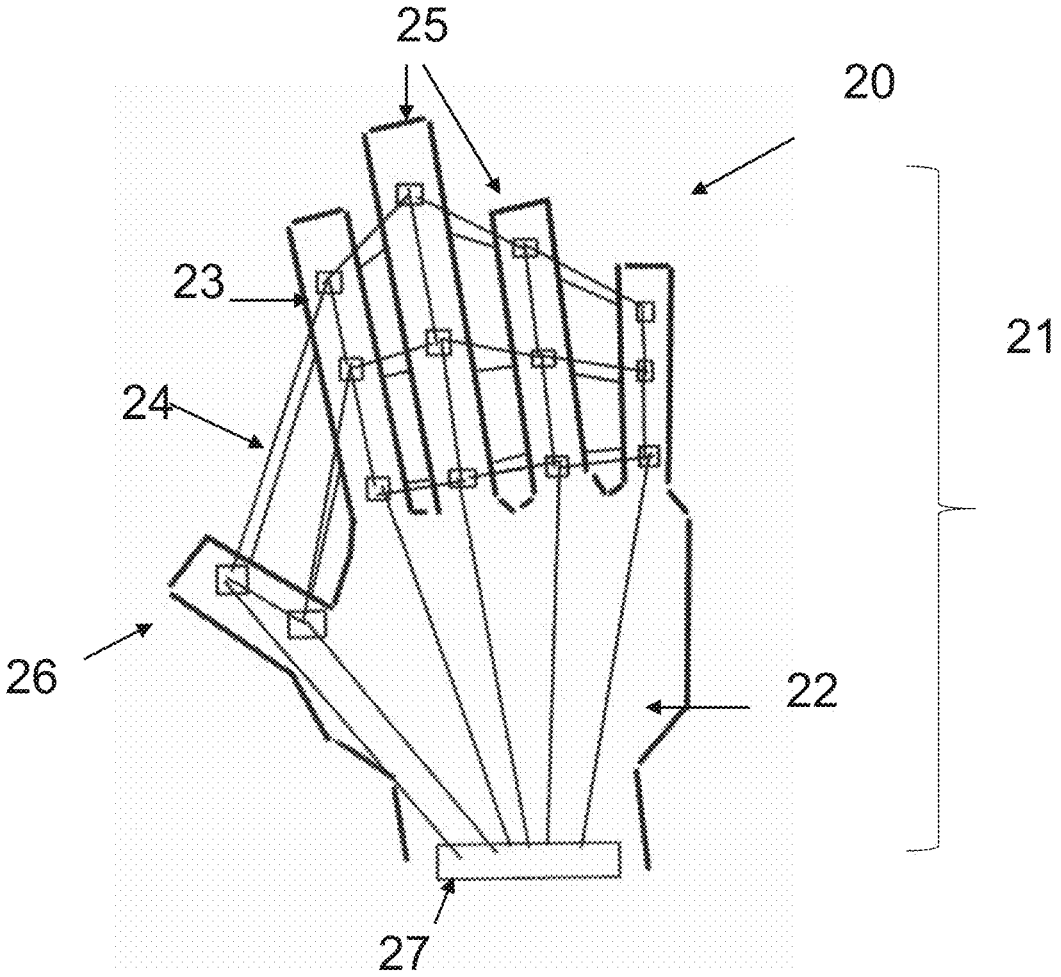
FIG. 2 is an illustration of a glove according to another embodiment of the present invention.

Alternatively, any portion(s) of the resistance bands 14 can be configured to extend outside of the planar surface or the planar surface area of the hand 11 and/or glove 10, as shown in FIG. 2.

Returning to FIG. 1, the resistance bands 14 can be configured to be removably attached to the connection points 13. For example, the resistance bands 14 can be removably attached to the connection points via anchoring mechanisms (not illustrated). Other suitable mechanisms for removably attaching the resistance bands 14 to the connection points 13 include, but are not limited to, snap-fit closure mechanisms, tie strips, bendable wire strips, adhesives, VELCRO® fasteners, removable joints, clips, and the like.

The connection points 13 can also be configured to removably attach the resistance bands 14 to the glove 10 via, for example, snap-fit closure mechanisms, tie strips, bendable wire strips, adhesives, VELCRO® fasteners, removable joints, clips, and the like.

The glove 10 can also include at least one adjustable resistance mechanism(s) (not illustrated) connected to the glove 10. In embodiments, the adjustable resistance mechanism(s) can be connected to or positioned at the outer surface area of the top surface 12 of the glove 10. Alternatively, the adjustable resistance mechanism(s) can be connected to or positioned at the outer surface area of the bottom surface of the glove 10. In cases where it is desired, the adjustable resistance mechanism(s) can be connected to or positioned at both the outer surface of the top surface 12 and bottom surface of the glove 10.

As such, in cases where there are multiple adjustable resistance mechanisms, the placement of the mechanisms is not particularly limited. For example, one or more adjustable resistance mechanisms can be placed on the outer surface area of the upper surface 12 of the glove 10, and the remainder can be placed on the outer surface area of the lower surface of the glove 10. Alternatively, all of the adjustable resistance mechanisms can be placed entirely on the upper surface 12 of the glove 10; or entirely on the lower surface.

Adjustable resistance mechanism(s) can also be secured or attached adjacent to the glove 10, such as at or near a location of where a user's wrist would be located. In embodiments, adjustable resistance mechanism(s) can also be secured to the glove 10 by way of a wire, rope, or a thread.

Suitable adjustable resistance mechanisms include, but are not limited to, a dial tensioner, an adjustable knob, and/or a series of buttons connected to the glove 10. With a dial tensioner, the resistance of the glove 10 can be adjusted based on a position of the dial, and similarly with changing a position of an adjustable knob. Regarding a series of buttons as an adjustable resistance mechanism, the glove 10 can be configured such that the resistance of the glove is controlled by push button configuration, similar to that of a remote control glove for a television, or thermostats in a house.

In embodiments, the at least one adjustable resistance mechanism can be configured to be able to adjust values or degrees of resistance to motion via the plurality of resistance bands 14.

In cases where it is desired, the glove 10 can include a single adjustable resistance mechanism to control or adjust separate regions of the glove 10 to separate levels and/or degrees of resistance. Alternatively, the glove 10 can include multiple adjustable resistance mechanisms, each of which may be configured to or adapted to adjust and/or control the resistance of separately assigned areas of the glove 10.

In certain embodiments, the adjustable resistance mechanism(s) can also be configured to control or allow for adjusting separate regions of the glove 10 to separate degrees of resistance. For example, the adjustable resistance mechanism(s) can be configured to control or adjust the resistance of the thumb 16 area to a separate level of resistance than the index finger, or to a separate level of resistance than any one and up to all of the remaining digits 15.

For example, the glove 10 can be configured to have one or more than one adjustable resistance mechanism(s) configured to allow for separately adjusting the degree or level of resistance for each individual digit 15. For example, each digit 15 can also have its level of resistance controlled by its own uniquely assigned adjustable resistance mechanism. Alternatively, a glove 10 can be configured having only one adjustable resistance mechanism, where the adjustable resistance mechanism is configured to only allow for the adjustment and/or control of the resistance of the thumb 16 and/or all adjustable resistance areas of the glove 10.

Accordingly, it will be appreciated that gloves of the present disclosure can be configured to have any number of adjustable resistance mechanism(s), which can further be configured to control and/or adjust the resistance corresponding to any one and up to all of the anatomically allowable and/or anatomically available movements of the hand 11 and corresponding digits 15.

As such, fingers, a type of digit on the human hand 11, can undergo several types of articulations and/or movements, based in part on its joint structure. Fingers contain both metacarpophalangeal and interphalangeal joints, with the exception of the thumb, or the opposing digit on the human hand. The thumb is discussed separately and in greater detail further below.

Metacarpophalangeal joints are located between the metacarpal bones and the phalanges of the fingers. Metacarpophalangeal joints are of the condyloid kind, formed by the reception of the rounded heads of the metacarpal bones into shallow cavities on the proximal ends of the first phalanges.

Metacarpophalangeal joints are capable of flexion, extension, adduction, abduction, and circumduction movements. Metacarpophalangeal flexion movements generally involve a bending of the joint resulting in a decrease of angle, such as moving the base of the fingers toward the palm of the hand. On the other hand, metacarpophalangeal extension movements generally involve a straightening of the joint resulting in an increase of angle, such as moving the base of the fingers away from the palm of the hand.

As for adduction and abduction movements, metacarpophalangeal adduction movements involve a medial movement toward the axial line of the hand, such as movement of the fingers toward the middle finger. Metacarpophalangeal abduction movements involve a lateral movement away from the axial line of the hand, such as moving the fingers away from the middle finger. Metacarpophalangeal adduction and abduction are limited however, and generally cannot be performed when the fingers or digits are flexed.

Finally, metacarpophalangeal circumduction movements are movements in which flexion, extension, adduction, and abduction movements are sequentially combined. As such, generally any joint whereby flexion, extension, adduction, and abduction movements can occur is also capable of circumduction movement.

Interphalangeal joints are joints located between the fingers bones, or phalanges, of the hand. In human hands, with the exception of the thumb, two sets of interphalangeal joints exist: (1) proximal interphalangeal joints (PIJ or PIP); and (2) distal interphalangeal joints (DIJ or DIP). Proximal interphalangeal joints are located between the first (proximal) and second (intermediate) phalanges, and distal interphalangeal joints are located between the second and third phalanges.

The only movements capable of being performed by interphalangeal joints are flexion and extension movements. Interphalangeal flexion movements generally involve the bending of the joint resulting in a decrease of angle, such as moving the distal two segments of the fingers toward the base of the finger. On the other hand, interphalangeal extension movements generally involve the straightening of the joint resulting in an increase of angle, such as moving the distal two segments of the fingers away from the base of the fingers.

With regard to the thumb, the human thumb has carpometacarpal, metacarpophalangeal, and interphalangeal joints. The carpometacarpal (CMC) joint of the thumb is also referred to the first carpometacarpal joint, or the trapeziometacarpal joint (TMC), because it connects the trapezium to the first metacarpal bone.

The CMC joint of the thumb is capable of flexion, extension, abduction, adduction, and opposition movements. The CMC thumb joint flexes and extends in a plane parallel to the palm. Flexion movements of the CMC thumb joint involve bending the joint resulting in a decrease of angle, such as moving the bone below the thumb toward the hand and slightly forward. Extension movements of the CMC thumb joint involve straightening the joint resulting in an increase of angle, such as moving the bone below the thumb away from the hand and slightly back.

With regard to adduction and abduction movements of the CMC thumb joint, the CMC joint adduct and abduct in a plane perpendicular to the palm. Adduction movements involve medial movement toward the midline of the body, such as moving the bone below the thumb toward the back of the wrist; whereas abduction movements of the CMC thumb joint involve lateral movement away from the midline of the body, such as moving the bone below the thumb toward the front of the wrist.

Finally, opposition movements of the CMC thumb joint involve diagonal movement of the thumb across the palm of the hand making contact with the fingers. Given the vast amount activities that the typical human can undertake using his/her hands (e.g., playing various sports, musical instruments, keyboard typing, grabbing, gripping, and holding items, etc.) the CMC (carpometacarpal) joint of the thumb can require a great deal of strength and flexibility training. Likewise, the CMC joint can be stressed repeatedly in its three main planes of movement: abduction-adduction, flexion-extension, and opposition and subject to debilitating conditions such as arthritis.

The metacarpophalangeal (MCP) joint of the thumb acts somewhat as a hinge joint, and is capable of flexion, extension, abduction and adduction movements. Flexion movements of the MCP joint of the thumb generally involve bending the joint resulting in a decrease of angle, such as moving the base of the thumb toward the heel of the hand. Extension movements of the MCP joint of the thumb generally involve straightening the joint resulting in an increase of angle, such as moving the base of the thumb away from the heel of the hand. MCP joint flexion and extension movements generally occur in a plane parallel to the palm.

Abduction movements of the MCP thumb joint involve lateral movement away from the midline of the body, such as a slight movement of the base of the thumb away from the back of the hand; whereas adduction movements of the MCP thumb joint involve medial movement toward the midline of the body, such as a slight movement of the base of the thumb toward the back of the hand. As with adduction and abduction movements of the CMC thumb joint, the MPC thumb joint also adducts and abducts in a plane perpendicular to the palm.

Unlike the remaining digits of the human hand, the thumb has only two phalanges and therefore only one interphalangeal (IP) joint. The interphalangeal joint of the thumb is capable of flexion and extension/hyperextension movements. In flexion movements, the IP joint of the thumb is bent resulting in a decrease of angle, such as moving the distal segments of the thumb toward the base of the thumb.

Extension/hyperextension movements of the IP joint of the thumb involve straightening of the joint resulting in an increase of angle, such as moving the distal segments of the thumb away from the base of the thumb.

Accordingly in view of the above, gloves of the present disclosure can be configured to individually control and/or adjust the resistance of at least one and up to all of metacarpophalangeal digit flexion, metacarpophalangeal digit extension, metacarpophalangeal abduction, metacarpophalangeal adduction, and/or metacarpophalangeal circumduction movement(s). The resistance can be controlled by one or more than one adjustable resistance mechanism(s) in multiple configurations, as discussed above.

In embodiments, the adjustable resistance mechanism(s) of gloves of the present disclosure can also be configured to individually control and/or adjust resistance for at least one and up to all of interphalangeal flexion and interphalangeal extension movement(s); and/or digit flexion and digit extension movement(s).

Moreover, the adjustable resistance mechanism(s) of the glove a10 can also be configured to individually control and/or adjust resistance for and one and up to all of adduction and abduction resisted movement; and/or flexion and extension resisted movement.

With regard to adduction and abduction resisted movement, lines 17, as shown in FIG. 1, indicate the resistance between the digits 15 (e.g., fingers) for abduction and adduction movements.

Gloves and devices of the present disclosure can also be configured to individually control and/or adjust resistance for circumduction movement. Moreover, it will be appreciated that the glove 10 can also be configured to individually control and/or adjust the resistance for any one and up to a combination of all of the thumb movements, as described above.

In embodiments, the material of the resistance bands is not particularly limited, and can be made of any strong, resilient, durable, flexible and non-toxic rubber, composite, or plastic material, such as natural and synthetic rubbers or a blend of synthetic rubbers, nylons, polyesters, and vinyl plastics. In embodiments, illustrative examples of suitable materials that the first and second portions can be made of include, but are not limited to, neoprene plastic, isoprene, styrene-butadiene rubber, butadiene, ethylene-propylene, butyl, chloroprene, nitrile rubber, polyurethane, polycarbonate, acrylonitrile butadiene styrene, and mixtures thereof.

In embodiments, the material of the glove is not particularly limited, and can be made of animal material (e.g., wool, silk, leather), plant material (e.g., cotton, flax, jute, hemp), and/or synthetic materials (nylon, polyester, acrylic fibers, latex and latex composites) and combinations thereof.

Suitable material for the glove also includes gripping material, such as any slip resistant, high friction and vibration dampening material capable of enhancing the overall strength and grasping capabilities of the glove.

In embodiments, portions of the glove can be reinforced with additional material. Said additional material can be located at one and up to all of the tips of the digits of the glove, the palm surface, the portion of the hand between the thumb and index finger, and/or at the location of one and up to all of the connection points.

The additional or reinforcing material can also be located across portions up to and including all of the surface area of the lower surface of the glove, and across portions including up to and including all of the surface area of the upper surface of the glove.

The additional of reinforcing material can be of the same or different material than the material of the glove. In embodiments, the material type of the additional material is not particularly limited and can be made of animal material (e.g., wool, silk, leather), plant material (e.g., cotton, flax, jute, hemp), and/or synthetic materials (nylon, polyester, acrylic fibers, latex and latex composite materials) and combinations thereof. Suitable material type also includes gripping material, such as any slip resistant, high friction and vibration dampening material capable of enhancing the overall strength and grasping capabilities of the glove.

In embodiments, the glove can be lined with additional material on the inner surface of and one of the inner surface(s) of the top and bottom surface(s) of the glove.

In certain embodiments, one and up to all of the digit tips of the glove can be open, thereby exposing the tip(s) of the digit(s) or finger(s).

With reference to FIG. 2, a glove 20 according to alternate embodiments of the present disclosure is illustrated. The glove 20 includes a top surface 22 and a bottom surface (not illustrated). Both the top surface 22 and the bottom surface of the glove 20 can also include an inner and an outer surface. The inner surface of the top surface 22 of the glove 20 can generally correspond to the surface of the glove that is closest in contact to a top surface of a hand 21, and the inner surface of the bottom surface of the glove 20 can generally correspond to the surface of the glove that is closest in contact to a bottom surface of the hand 21 (e.g., where a palm of the hand 21 is located).

The glove 20 can be configured to substantially cover the hand 21, including a plurality of digits 25 with a thumb 26, similar and corresponding to configurations for glove 10 of FIG. 1 contemplated herein. As such, the above description regarding coverage configurations of glove 10 of FIG. 1 applies to glove 20 of FIG. 2 and is incorporated herein by reference in its entirety. Accordingly, for sake of brevity and clarity, the above description regarding coverage configurations will not be repeated herein.

A plurality of connection points 23 can also be provided across the outer surface area of the glove 20. The glove 20 can also include a plurality of resistance bands 24 removably attached throughout the outer surface area of the glove 20. As shown in FIG. 2, in cases where it is desired, the resistance bands 24 can extend outside of a planar surface of the hand 21 (see e.g., the resistance bands 24 extending across the space between the thumb 26 and index finger of FIG. 2).

The resistance bands 24 can be removably attached to the glove 20 at the connection points 23. The above description regarding the resistance bands 14 and the connection points 13 of glove 10 of FIG. 1 applies in its entirety to glove 20 of FIG. 2, and is incorporated herein by reference in its entirety. Accordingly, the above description regarding the resistance bands 14 and connection points 13 of FIG. 1 will not be repeated herein for sake of brevity and clarity.

The glove 20 can also include at least one adjustable resistance mechanism 27. The above description regarding adjustable resistance mechanism(s) with regard to the glove 10 of FIG. 1 applies to glove 20 of FIG. 2, and is incorporated herein by reference in its entirety. Accordingly, the above description regarding adjustable resistance mechanism(s) will not be repeated herein for sake of brevity and clarity.

Gloves of the present invention also include embodiments where resistance band(s) are fixably or substantially permanently attached or affixed to the glove. Namely, instead of being removably attached to the glove, the resistance bands can be substantially permanently affixed to the glove.

Suitable examples for fixably attaching resistance bands to the glove include, but are not limited to, sewing, molding, stapling, clamping, superficially attaching resistance bands to the outer surface of the glove, and/or tying resistance bands into the material and/or surface of the glove, and/or applying adhesive(s) between the resistance bands and the material and/or surface of the glove, and the like.

In cases where resistance band(s) are fixably attached to the glove, the glove can also be configured to allow for a set degree and/or set range of resistance values. Therefore, instead of including an adjustable resistance mechanism to control or adjust the resistance of the glove, the glove can be pre-configured to allow for a set degree and/or a set range of resistance values associated with various hand and finger articulations and movements.

For example, gloves where resistance bands are fixably attached to the glove can be configured to allow for a set degree and/or a set range of resistance values for at least one and up to all of: metacarpophalangeal digit flexion movement, metacarpophalangeal digit extension movement, metacarpophalangeal abduction movement, metacarpophalangeal adduction movement, metacarpophalangeal circumduction movement, interphalangeal flexion movement, interphalangeal extension movement, digit flexion movement, digit extension movement, adduction and abduction movement, thumb movement, flexion resisted movement, extension resisted movement, and/or circumduction resisted movement.

Also provided herein are methods for controlling and adjusting hand movement. Methods include applying a glove to cover a hand. The glove can include a at least one resistance band. The resistance band(s) can be similar to those described herein.

Methods can further include adjusting and controlling degrees of resistance to motion using the resistance band(s) of the glove. The motion(s) that can be adjusted include any motion capable of being anatomically performed by a hand, including but not limited to any one of the above-described motions.

It will also be appreciated that gloves of the present disclosure can be used in methods for rehabilitating a subject, and well as in methods for engaging in athletic and movement-related activities and exercising. More specifically, gloves of the present disclosure can be used while engaged in any number of athletic, movement-related, and/or sporting activities, such as playing football, baseball, running, walking, playing tennis, and the like. In any one of these sports and/or activities, a user's hand can be engaged in, e.g., throwing a ball, grasping a bat or racquet, catching a ball, and/or grabbing and holding onto surfaces. Because it is not necessary for a user to remove the glove when engaged in such activities, a user can benefit from added resistance to various engaged joint and muscle groups.

Accordingly, it may be beneficial for the user to utilize the glove while simultaneously engaged in activities to, for example, provide for additional training, strength conditioning, flexibility development, muscle development, and the like in various ranges of movement, as well as for rehabilitative treatment. As noted above, a user can utilize the glove of the present disclosure and wear it on his/her hand while catching a ball. This way, various joints and muscles that are typically used to grip and hold the ball can be further strengthened and enhanced, by adding resistance to said joints and muscles through the glove.

The corresponding structures, materials, acts, and equivalents of all means plus function elements in the claims below are intended to include any structure, or material, for performing the function in combination with other claimed elements as specifically claimed. The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It will be appreciated that not all of the features, components and/or activities described above in the general detailed description in relation to embodiments of the present disclosure or the examples are required, that a portion of a specific feature, component and/or activity may not be required, and that one or more further features, components and/or activities may be required, added or performed in addition to those described. Still further, the orders in which activities are listed are not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention.

Further, references to values stated in ranges include each and every value within that range, and the endpoints of said ranges. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is provided to comply with Patent Law and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. A glove comprising:

a top surface and a bottom surface;

a plurality of connection points positioned across an outer surface area of the glove;

a plurality of resistance bands configured to be removably attached to the plurality of connection points; and at least one adjustable resistance mechanism connected to the glove and configured to be located at a user's wrist, wherein the at least one adjustable resistance mechanism is configured to adjust degrees of resistance to motion via the plurality of resistance bands, wherein the at least one adjustable resistance mechanism is configured to adjust resistance bands of separate regions of the glove to separate degrees of resistance, the at least one adjustable resistance mechanism is configured to separately adjust the degree of resistance for each individual digit to different degrees of resistance, the glove includes a separate adjustable resistance mechanism for each individual digit, and one or more adjustable resistance mechanisms are located simultaneously on both the top surface of the glove and on the bottom surface of the glove.

2. The glove of claim 1, wherein the glove is configured to cover an entirety of a user's hand.

3. The glove of claim 1, wherein the plurality of connection points are located at positions corresponding to digit joint locations along a length of digits of the glove.

4. The glove of claim 3, wherein each connection point is located at a position corresponding to a digit joint location.

5. The glove of claim 4, wherein the glove includes three connection points at positions corresponding to digit joint locations along the length of one digit of the glove.

6. The glove of claim 3, wherein the plurality of connection points are positioned at a proximal interphalangeal finger joint, a metacarpophalangeal finger joint and a distal interphalangeal finger joint of at least one digit.

7. The glove of claim 6, wherein the connection points are tie strips and the resistance bands are configured to be removably attached to corresponding tie strips.

8. The glove of claim 1, wherein the plurality of connection points are simultaneously located at positions on both the top surface and bottom surface of the glove.

9. The glove of claim 7, wherein connection points on the bottom surface of the glove are located at positions corresponding to digit joint locations along a length of digits of the glove.

10. The glove of claim 1, wherein each resistance band extends to a wrist of the glove.

11. The glove of claim 1, wherein at least one of the plurality of resistance bands extends across the space between two digits.

12. The glove of claim 11, wherein at least two resistance bands extend across the space between two digits.

13. The glove of claim 12, wherein three resistance bands extend across the space between two digits.

14. The glove of claim 13, wherein the positions at which each band extending across the space between two digits is located corresponds to digit joint locations on each digit.

15. The glove of claim 1, wherein the glove is configured to allow for only certain degrees of movement for a select number of digits.

* * * * *